US006979066B2

(12) United States Patent
Yang

(10) Patent No.: US 6,979,066 B2
(45) Date of Patent: Dec. 27, 2005

(54) RAIL ASSEMBLY FOR FURNITURE

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 84 days.

(21) Appl. No.: 10/848,114

(22) Filed: May 19, 2004

(65) Prior Publication Data

US 2005/0092217 A1 May 5, 2005

Related U.S. Application Data

(63) Continuation-in-part of application No. 10/694,728, filed on Oct. 29, 2003.

(51) Int. Cl.[7] ..... A47B 88/00
(52) U.S. Cl. ..... 312/333; 312/334.46; 312/319.1
(58) Field of Search ..... 312/319.1, 333, 312/334.44, 334.46, 334.47; 384/21

(56) References Cited

U.S. PATENT DOCUMENTS 5,302,016 A * 4/1994 Lautenschlager et al. ... 312/333
6,736,471 B2 * 5/2004 Lin ..... 312/333
6,799,817 B1 * 10/2004 Chu ..... 312/333
6,848,759 B2 * 2/2005 Doornbos et al. ..... 312/319.1
2004/0000850 A1 * 1/2004 Lam Harn et al. ..... 312/333
2004/0183411 A1 * 9/2004 Boks ..... 312/333
2004/0227438 A1 * 11/2004 Tseng et al. ..... 312/333
2004/0239218 A1 * 12/2004 Jurja ..... 312/333
2005/0104492 A1 * 5/2005 Chiu ..... 312/333

FOREIGN PATENT DOCUMENTS

EP 391221 * 10/1990 ..... 312/333

* cited by examiner

*Primary Examiner*—Lanna Mai
*Assistant Examiner*—Hanh V. Tran
(74) *Attorney, Agent, or Firm*—Fei-Fei Chao; Bingham McCutchen LLP

(57) ABSTRACT

A rail assembly for furniture has a stationary track, an internal track, a sliding frame, a latch bracket and a resilient latch. The sliding frame has a latch tab, and a guiding block with an inclined face is mounted on the latch tab. With the arrangement of the guiding block, the rail assembly can be assembled and reassembled easily and conveniently.

5 Claims, 8 Drawing Sheets

RAIL ASSEMBLY FOR FURNITURE

This invention is a continuation-in-part (CIP) application of an application with an application Ser. No. 10/694,728 filed on Oct. 29, 2003.

BACKGROUND OF THE INVENTION

1. Field of the Invention

The present invention relates to a rail assembly, and more particularly to a rail assembly that is easily and conveniently assembled and reassembled.

2. Description of Related Art

To make a drawer close automatically, manufacturers often include a spring in a rail assembly for a drawer. However, a conventional rail assembly often has a complex structure, and the cost of the rail assembly is high. Furthermore, the conventional rail assembly only has one spring that easily breaks due to elastic fatigue. In addition, when the spring disengages from the rail assembly, to reassemble the spring to the rail assembly is difficult and time-consuming.

To overcome the shortcomings, the present invention provides a rail assembly for furniture to mitigate or obviate the aforementioned problems.

SUMMARY OF THE INVENTION

The primary objective of the present invention is to provide a rail assembly for furniture and that is easily and conveniently assembled and reassembled. The rail assembly has a stationary track, an internal track, a sliding frame, a latch bracket and a resilient latch assembly. The sliding frame has a latch tab, and a guiding block with an inclined face is mounted on the latch tab. With such an arrangement, the latch will be pushed to pivotally rotate when the latch abuts against the inclined face on the guiding block, and the rail assembly can be assembled or reassembled easily and conveniently.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
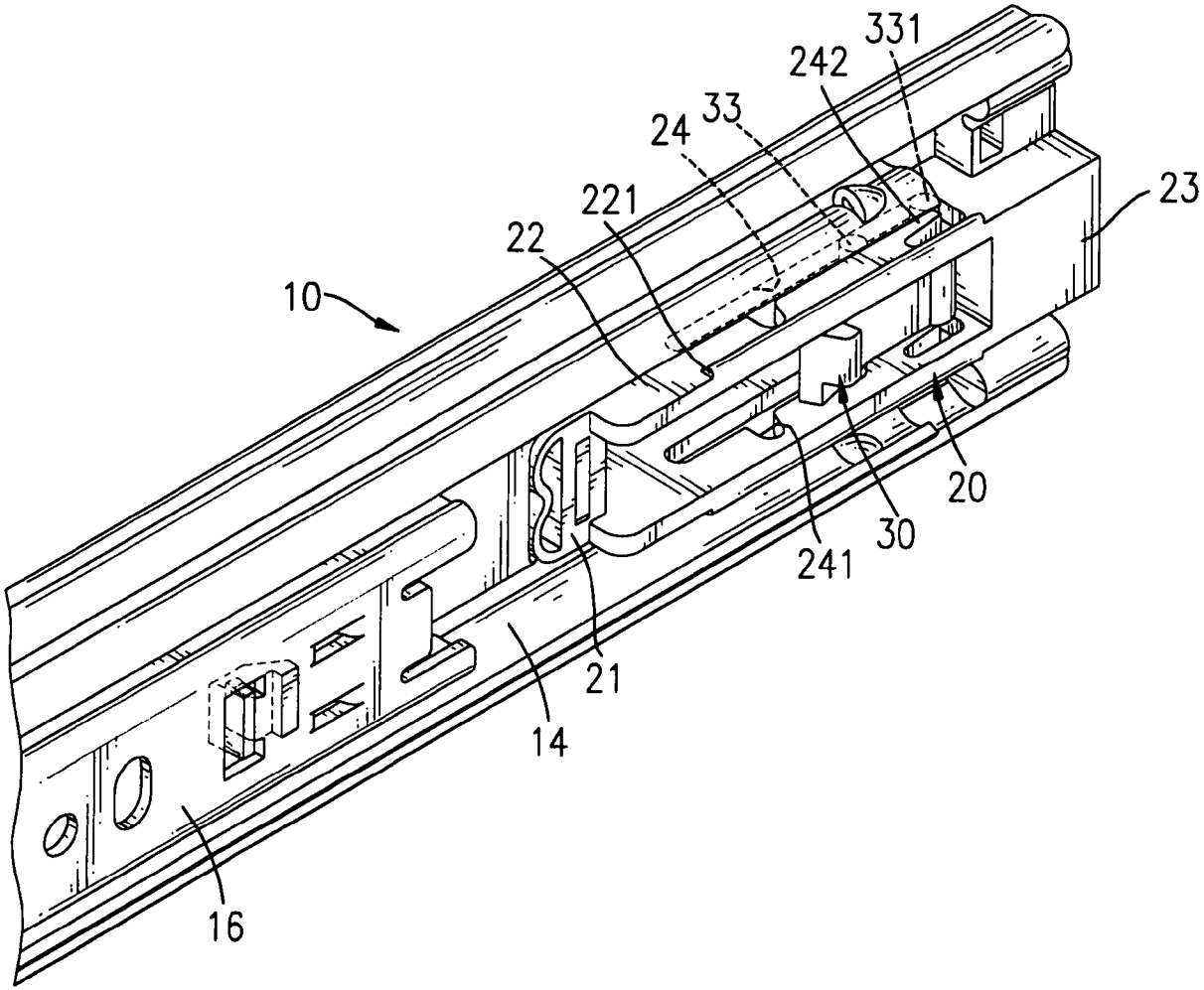
FIG. 1 is a perspective view of a rail assembly for furniture in accordance with the present invention.

With reference to FIGS. 1 to 4, a rail assembly for furniture in accordance with the present invention comprises a stationary track (10), an internal track (14), a sliding frame (16), a latch bracket (20) and a resilient latch assembly (30).

The stationary track (10) is U-shaped and has an inner end (101), an outer end opposite to the inner end (101), two locking holes (11), a mounting tab (12), two side edges and two longitudinal guides (102). The locking holes (11) are defined through the stationary track (10) near the inner end (101) and are aligned transversely with each other. The mounting tab (12) is formed on and extends perpendicular from the inner surface of the stationary track (10) at a distance from the locking holes (11) toward the outer end of the stationary track (10). The longitudinal guides (102) are defined respectively at the side edges.

The internal track (14) is mounted moveably inside the stationary track (10) and is conventional so further description of the features and operation is not included.

The sliding frame (16) is mounted slidably inside the internal track (14) in a conventional manner so further discussion of the features associated with mounting the sliding frame (16) inside the internal track (14) is not included. The sliding frame (16) has an inner end (160), an outer end opposite to the inner end (160), two protrusions (162), a latch tab (161) and a guiding block (163).

The protrusions (162) are formed on and protrude from the sliding frame (16) near the inner end (160). The latch tab (161) is also formed on and protrudes from the sliding frame (16) at a distance from the protrusions (162) toward the outer end of the sliding frame (16). The guiding block (163) is attached to the latch tab (161) and has an inclined face (164) facing the inner end (160) of the sliding frame (16).

The latch bracket (20) is mounted securely at the inner end of the stationary track (10) and has an inner end (200), an outer end (21), a body (23), two keys (25) and a pair of rails (22).

The body (23) has a rear surface, a cavity (231), a top side, a bottom side and two locking protrusions (27). The cavity (231) is defined in the rear surface of the body (23). Each locking protrusion (27) is respectively formed on the rear surface of the body (23) besides the cavity (231).

The keys (25) are integrally formed respectively on the top side and the bottom side of the body (23) and are mounted respectively inside the longitudinal guides (102) of the stationary track (10). Each key (25) has a rear surface and a spring holder (251). The spring holders (251) are recessed and communicate with the cavity (231) in the body (23). The outer end (21) is a reversed B-shape and has a transverse mounting slot (211). The pair of rails (22) are formed integrally with the body (23), are parallel to each other, and respectively have longitudinal guide slots (24). Each longitudinal guide slot (24) has an inner end, a transverse stop notch (241) and an outer end. The inner end is J-shaped and has a tongue (242). The transverse stop notches (241) are formed near the outer ends of the longitudinal guide slots (24) and are aligned with each other. The latch bracket (20) is attached to the stationary track (10) by mounting the locking protrusions (27) respectively inside the locking holes (11) and the mounting slot (211) on the mounting tab (12).

The resilient latch assembly (30) is slidably mounted inside the latch bracket (20) and has a latch (31) and two springs (37). The latch (31) is slidably mounted between the rails (22) and has an outer end, an inner end, a front surface, a rear surface, a top side, a bottom side, a middle portion, two guide posts (33), two locking posts (331), a spring bracket (35) and a hook (32). The guide posts (33) are formed respectively on the top side and the bottom side at the middle portion, and the locking posts (331) are formed respectively on the same sides as the guide posts (33) near the inner end. The posts (33, 331) are slidably mounted respectively inside the longitudinal guide slots (24), and the locking posts (331) are selectively held respectively inside the transverse stop notches (241) to hold the latch (31) at the outer end (21) of the latch bracket (20). The spring bracket (35) is formed on the rear surface of the latch (31) at the middle portion and has two notches (351). The hook (32) is formed on and extends out from the front surface of the latch (31) at the outer end and engages with the guiding block (163) on the latch tab (161).

The springs (37) are mounted between the latch (31) and the body (23). Each spring (37) has two ends (371) and two necks (372) that are respectively near the ends (371). One end (371) of each spring (37) is mounted in the corresponding spring holder (251) on the wing (25), and the other end (371) is mounted in the corresponding notch (351) in the spring bracket (35) by mounting the necks (371) respectively in the notches (351) and the spring holders (251).

Figure 5:
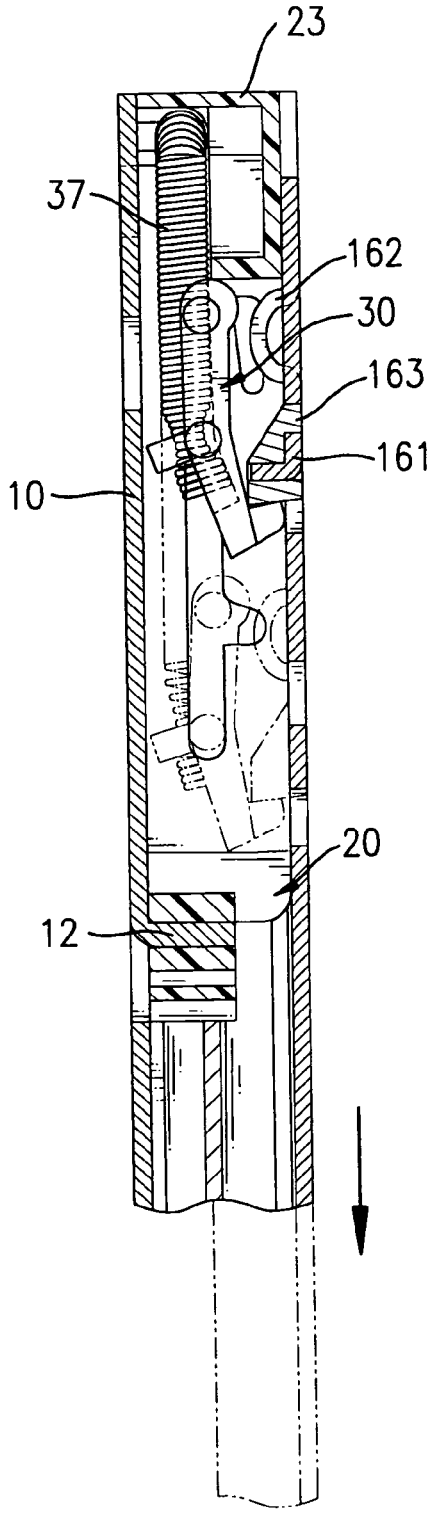
FIG. 5 is an operational enlarged top plan view in partial section of the rail assembly in FIG. 1.

With further reference to FIG. 5, the locking posts (331) move into the transverse stop notches (241) in the rails (22) when a drawer with the rail assembly in accordance with the present invention is opened. When the locking posts (331) move into the transverse stop notches (241), the resilient latch assembly (30) will pivot causing the hook (32) to release the latch tab (161) and allow the sliding frame (16) to be pulled out.

When the sliding frame (16) is pushed in, the protrusions (162) press against the inner end of the latch (31) and push the locking posts (331) out of the transverse stop notches (24) and cause the hook (32) to engage the guiding block (163) on the latch tab (161). Because of the elastic force in the springs (37), the latch (31) will be pulled against the body (23). The springs (37) securely hold the latch (31) and the sliding frame (16) against the body (23) until the sliding frame (16) is pulled out to release the latch (31) as previously described.

Figure 2:
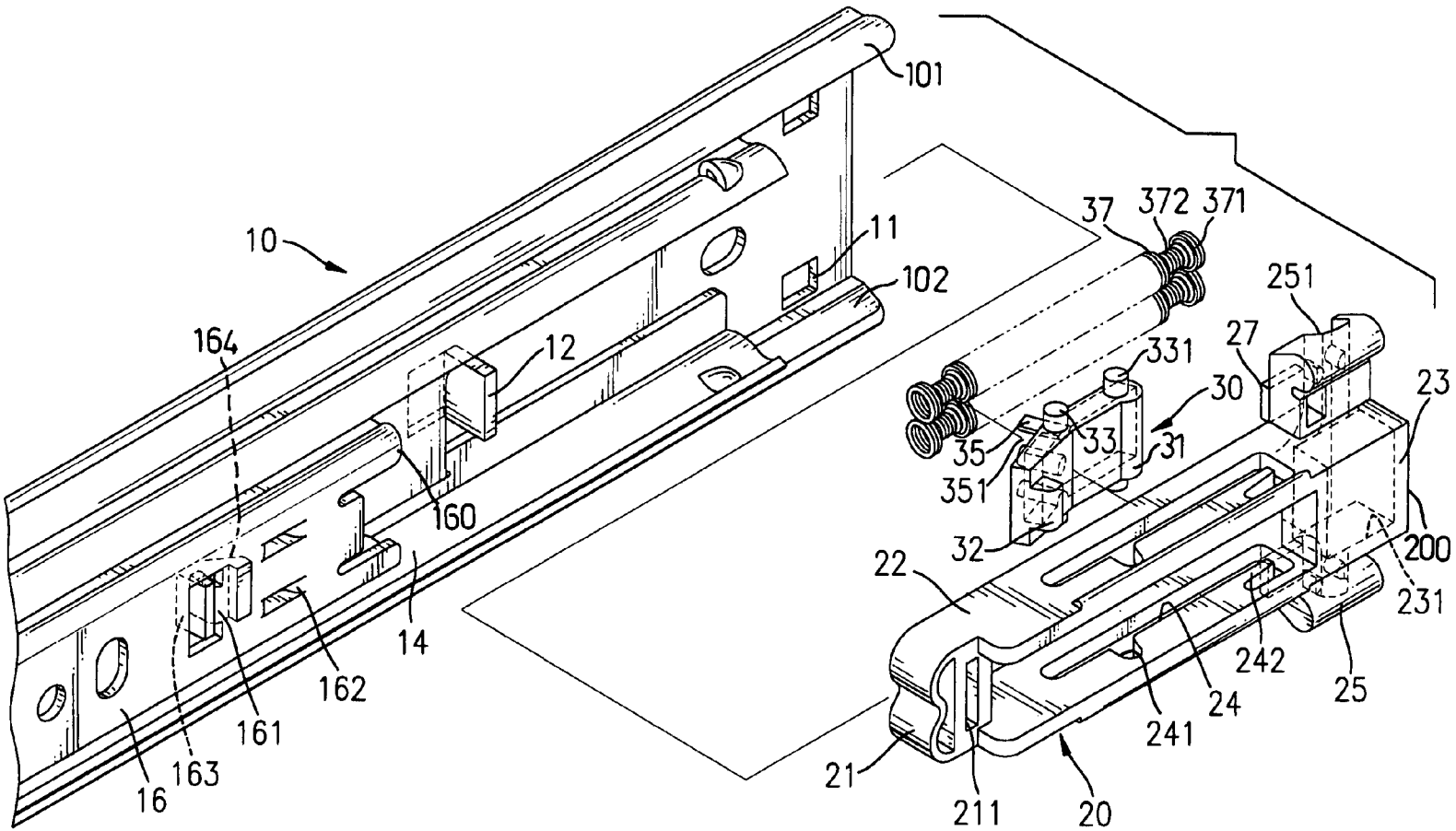
FIG. 2 is an exploded perspective view of the rail assembly in FIG. 1.
Figure 3:
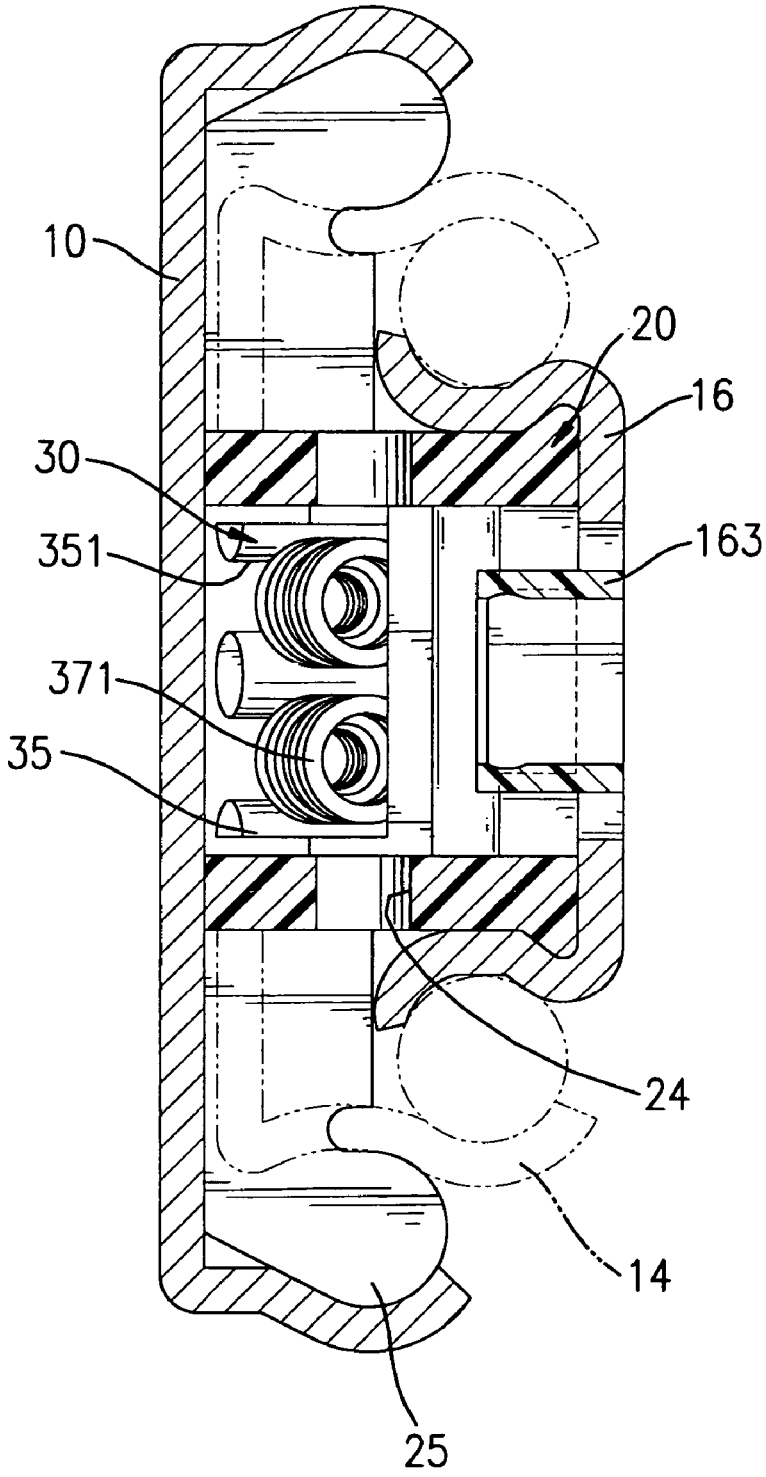
FIG. 3 is an enlarged front plan view in partial section of the rail assembly in FIG. 1.
Figure 4:
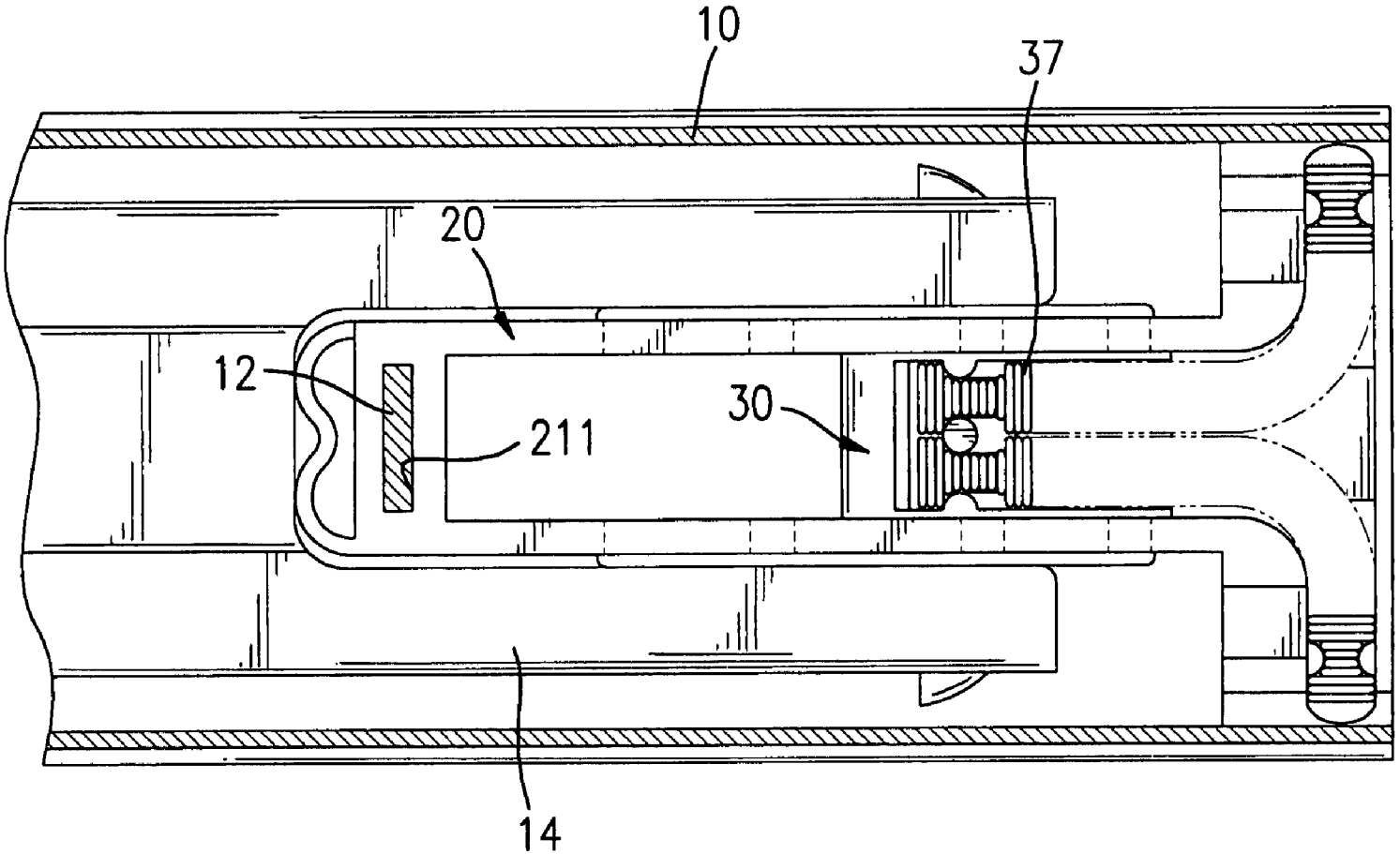
FIG. 4 is an enlarged side plan view in partial section of the rail assembly in FIG. 1.
Figure 6:
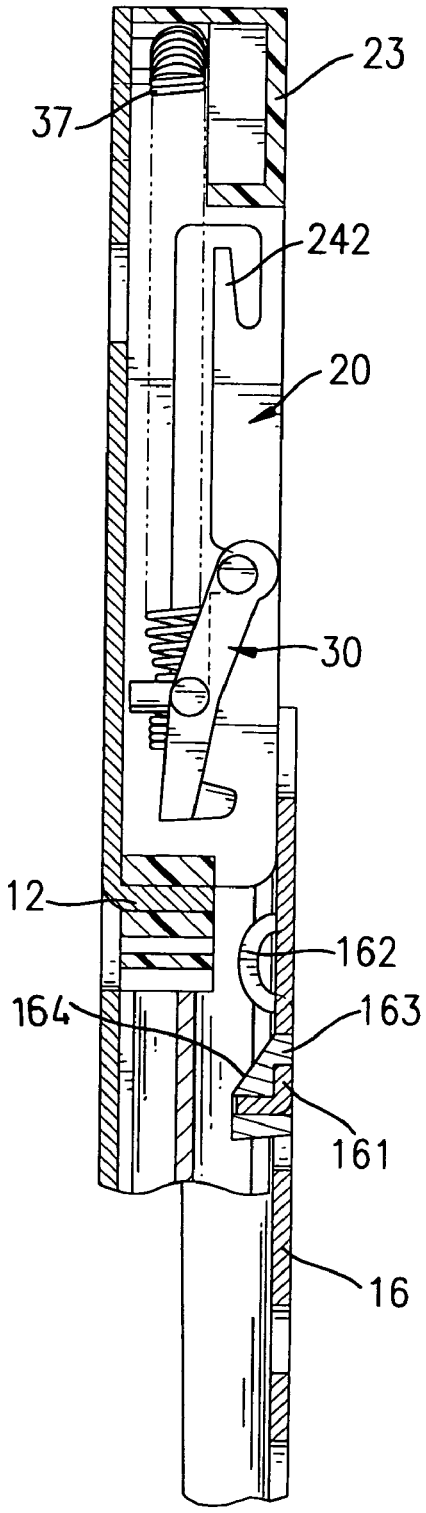
FIG. 6 is an enlarged top plan view in partial section of the rail assembly in FIG. 1 showing that the latch is disengaged from the guiding block.
Figure 7:
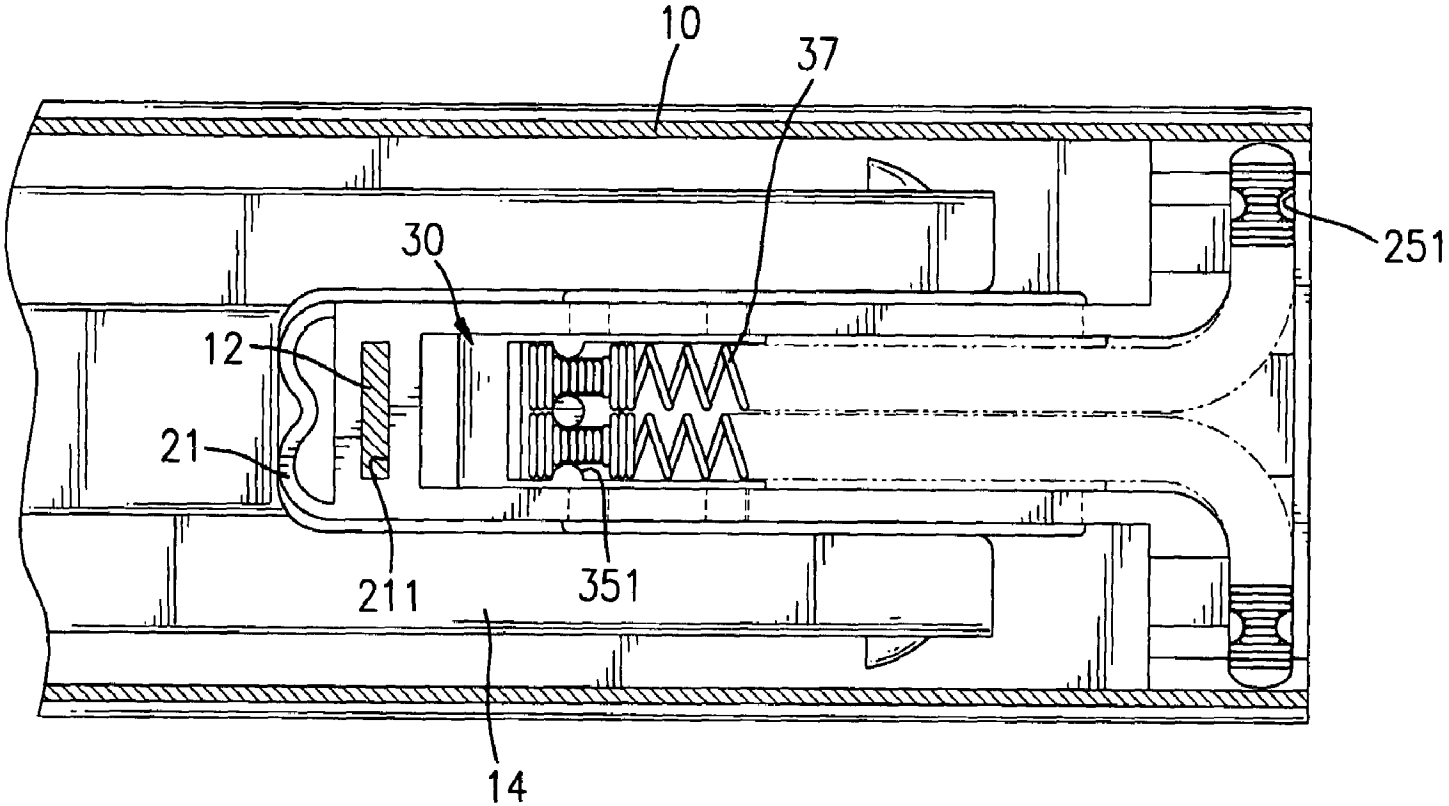
FIG. 7 is an enlarged side plan view in partial section of the rail assembly in FIG. 6.
Figure 8:
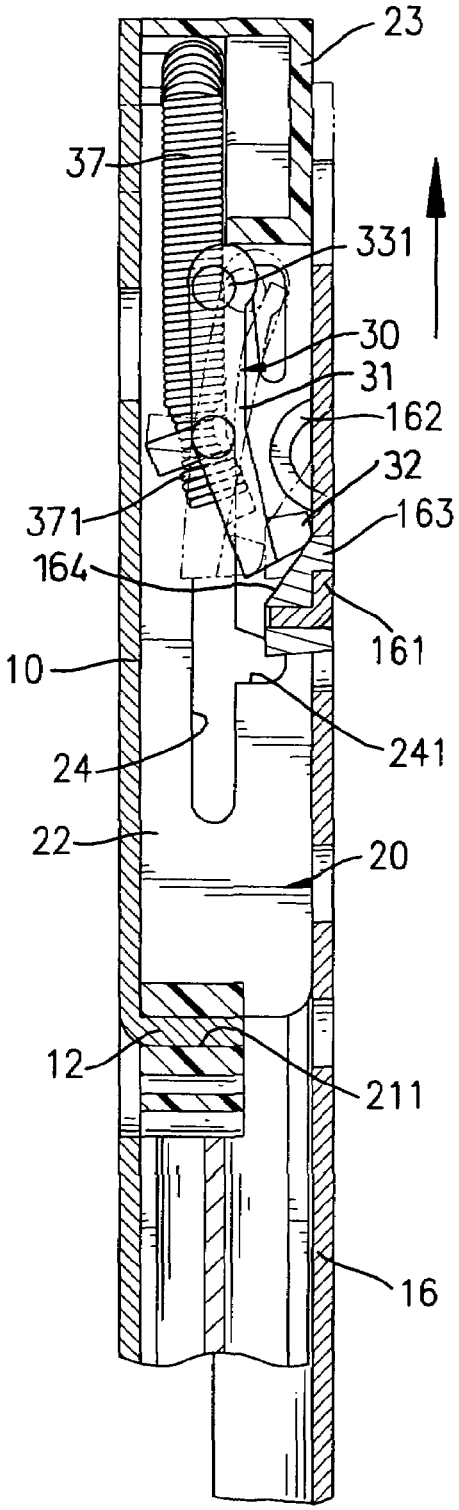
FIG. 8 is an operational enlarged top plan view in partial section of the rail assembly in FIG. 1 showing that the rail assembly is reloaded.

With reference to FIGS. 2, 6 and 7, if the movement of the drawer is too long to make the hook (32) of latch assembly (30) disengage from the guiding block (163), an automatically retracting effect is not further provided to the drawer. In this situation, with further reference to FIG. 8, the drawer is moved backward to make the inclined face (164) on the guiding block (163) abut against the hook (32). The latch (31) will be pushed to pivotally rotate relative to the latch bracket (20) along the inclined face (164) of the guiding block (163), and the hook (32) will reengage with the guiding block (163). Accordingly, the rail assembly is reloaded to provide an automatically retracting effect to the drawer, such that to assemble or to reassemble the rail assembly is easy, convenient and timesaving.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rail assembly for furniture having a stationary track having an inner end;

an outer end opposite to the inner end two side edges; and two longitudinal guides formed respectively at the side edges;

an internal track slidably mounted on the stationary track;

a sliding frame slidably mounted on the inner track and having an inner end corresponding to the inner end of the stationary rail;

two protrusions formed on the sliding frame near the inner end;

a latch tab formed on the sliding frame at a distance from the protrusions toward the outer end; and a guiding block mounted on the latch tab and having an inclined face facing the inner end;

a latch bracket mounted inside the stationary track at the inner end and having an inner end corresponding to the inner end of the stationary rail;

an outer end opposite to the inner end;

a pair of rails extending from the latch bracket in parallel and each having a longitudinal guide slot defined in the rail and a transverse stop notch communicating with the longitudinal guide slot;

a body formed on the inner end and having a top side; and a bottom side; and two keys formed respectively on the top side and the bottom side of the body and mounted respectively inside the longitudinal guides of the stationary track; and a resilient latch assembly slidably mounted inside the latch bracket and having a latch slidably mounted inside the latch bracket between the rails and having an inner end corresponding to the inner end of the stationary rail;

an outer end opposite to the inner end;

a front surface;

a rear surface;

two sides;

a middle portion;

two guide posts being respectively formed on one of the sides at the middle portion and slidably mounted inside the longitudinal guide slots;

two locking posts being respectively formed on the same sides as the guide posts near the inner end and slidably mounted inside the longitudinal guide slots;

a spring bracket formed on the rear surface of the latch at the middle portion with two notches; and a hook formed on the front surface at the outer end and engaging with the guiding block; and two springs being mounted between the latch and the body.

2. The rail assembly as claimed in claim 1, wherein the stationary track further comprises two locking holes defined near the inner end of the stationary track; and a mounting tab formed on the stationary track at a distance from the locking holes toward the outer end;

the latch bracket further comprises a mounting slot transversely defined at the outer end;

the body of the latch bracket has a rear surface; and two protrusions formed on the rear surface to respectively engage with the corresponding locking holes in the stationary track;

each key of the latch bracket has a spring holder to hold the springs of the resilient latch assembly; and each spring further has two necks mounted respectively inside the spring holders and the latch bracket.

3. The rail assembly as claimed in claim 2, wherein the body of the latch bracket has a cavity defined in the rear surface.

4. The rail assembly as claimed in claim 3, wherein the spring holders communicate with cavity in the body.

5. The rail assembly as claimed in claim 1, wherein each longitudinal guide slot has a J-shaped inner end to form a tongue on the inner end.

* * * * *